United States Patent [19]

Backofen, Jr. et al.

[11] Patent Number: 4,628,819

[45] Date of Patent: Dec. 16, 1986

[54] DISINTEGRATING TAMPER MASS

[75] Inventors: Joseph E. Backofen, Jr., Herndon, Va.; James A. Petrousky, Port Tobacco, Md.; Donald J. Butz, Columbus, Ohio; David W. Holmes, Ellicott City; Ernest C. Faccini, Marbury, both of Md.; Arleigh E. McCree, Sylmar, Calif.

[73] Assignee: The United States of America as represented by the Secretary of the Navy, Washington, D.C.

[21] Appl. No.: 766,219

[22] Filed: Aug. 16, 1985

[51] Int. Cl.[4] ..... F42B 1/02

[52] U.S. Cl. ..... 102/307; 102/309; 102/476; 102/303

[58] Field of Search ..... 102/306–310, 102/333, 312, 313, 476; 89/36.02; 109/82, 83, 85

[56] References Cited

U.S. PATENT DOCUMENTS

| | | | |
|---|---|---|---|
| 1,400,104 | 12/1921 | Thorig | 109/83 |
| 1,474,389 | 11/1923 | Trowbridge et al. | 109/83 |
| 1,574,180 | 2/1926 | Strauss | 89/36.02 X |
| 3,633,520 | 1/1972 | Stiglich, Jr. | 109/82 |
| 4,185,551 | 1/1980 | Drimmer et al. | 102/307 X |
| 4,464,993 | 8/1984 | Porter | 102/319 X |
| 4,498,367 | 2/1985 | Skolnick et al. | 102/309 X |
| 4,499,830 | 2/1985 | Majerus et al. | 102/309 X |

*Primary Examiner*—Peter A. Nelson

*Attorney, Agent, or Firm*—Kenneth E. Walden

[57] ABSTRACT

A tamper mass including particulate material held together by a binder in a self-contained supporting shape surrounding a concavity in a forward face containing an explosive, whereby upon detonation of the explosive, the tamper material provides initial and temporary confinement of detonation products to directing forces forward. After shock loading, the tamper material disintegrates into very fine particles, which individually contain very little energy in dispersion.

12 Claims, 7 Drawing Figures

DISINTEGRATING TAMPER MASS

BACKGROUND OF THE INVENTION

1. Technical Field

The present invention relates in general to explosive devices, and relates in particular to means for containing and controlling the forces of explosive devices.

2. Background Art

Expendable perforators are used in many applications and generally include an explosive charge associated with a projectile for driving that projectile against a target. Such perforators are used in well boring and barrier penetration, as well as in bomb dearmament and disposal applications.

These perforators often have problems associated with side and end loss of explosive force about the outer perimeter of the projectile. This is an especially critical loss for small perforators. To overcome this problem, many expendable perforators include a means for containing the explosive force of the detonated charge so that detonation energy is concentrated on accelerating the projectile in a forward direction.

However full capability of such expendable perforators for industrial and commercial uses has not been achieved because no economically feasible and operationally satisfactory device has been developed which is acceptable for use in or in proximity to areas where there may be personnel or property which is susceptible to damage. More specifically, the detonation of explosive charges in accomplishing a cutting or severing function causes the generation of dangerous flying fragments as well as an overpressure of blast effect, either of which is a source of possible injury to personnel or property in proximity to the blast. Attempts have been made to develop an explosive device which is shielded to guard against fragmentation and blast effect. For example, it has been proposed that in conjunction with a linear-shaped charge a relatively heavy metal shield be secured by bolts or rivets to a member to be cut or severed. This approach has been found to be unsatisfactory because it is unsuccessful in reducing the blast effect, and the securing devices are torn from their moorings, thus becoming very dangerous projectiles themselves.

Other designs for containment devices have included a shield for restricting the blast effect and for containing an energy absorbing means around the explosive charge and between that charge and the shield. However, this device is intended to perforate a workpiece by exploding a hole in that workpiece and does not drive a projectile through the workpiece. Accordingly, the device is not a tamper mass and merely confines an explosion and does not provide any tamper function. Furthermore, it does not include any projectile. Therefore, side and end losses are not of concern to this containment device. Furthermore, this device includes a shield which must be secured to the surface being penetrated in order to support the shield and energy absorbing means. Therefore, this design has a possibility of having a fastener subjected to the explosion and becoming a dangerous projectile hurled away from the surface toward people in the vicinity of the device. Even beyond this problem; however, is the problems associated with the requirement of attaching the device to an object being penetrated. This requirement is not significant if the device is used to penetrate a wall or the like. However, if the device is used to dearm a bomb dud, a requirement that the penetrator device be affixed to the object being penetrated presents serious problems because many bombs have antidisturbance devices in them. Therefore, mounting a dearming device on a bomb dud should require as little disturbance to that bomb dud as possible so that personnel are subjected to as little danger to bomb explosion via antidisturbance device activation as possible.

SUMMARY OF THE INVENTION

It is a main object of the present invention to provide an explosive device for use as an expendable wall perforator which can be used notwithstanding the presence of personnel or property in the immediate proximity of the blast and without presenting a possibility of significant injury to either personnel or property.

It is another object of the present invention to provide a blast containment device for use with an expendable perforator which can be used notwithstanding the presence of personnel or property in the immediate proximity of the blast and without presenting a possibility of significant injury to either personnel or property.

It is another object of the present invention to provide a blast containment device for use with a bomb dearming device which reduces the possibility of activating the bomb via an antidisturbance device associated with that bomb.

These and other objects are accomplished by providing a tamper mass of particulate material which may include particles bound together by a binder into a monolithic self-supporting configuration.

The tamper mass provides sufficient inertial confinement of detonation products and energy to substantially reduce or almost completely eliminate side and end losses thereby enabling the detonation energy to be efficiently concentrated on accelerating a projectile. However, upon shock loading associated with detonation, the self-supporting tamper mass configuration disintegrates into very fine particles of which individually possess little momentum. These fine particles, in turn, disperse and decelerate rapidly whereby they will not have sufficient energy to cause significant harm to personnel or property located beyond a range associated with the immediate vicinity of the detonation. However, the temporary confinement properties of the device provide the equivalent amount of tamping as does solid materials such as steel plates of equivalent mass, and the self-supporting feature of the device permits mounting thereof with only very minimum mounting means.

DETAILED DESCRIPTION OF THE PREFERRED EMBODIMENT

Figure 1:
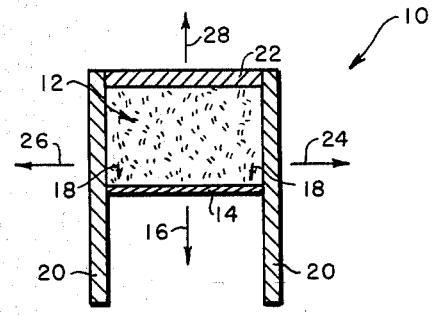
FIG. 1 (PRIOR ART)
FIG. 1 is an expendable perforator embodying the prior art.

Shown in FIG. 1 is a known expendable penetrator 10 in which an explosive charge 12 is used to accelerate a projectile 14, such as a strip of steel or the like, toward a target (not shown) via path 16 to impact and penetrate that target.

End or side losses of explosive energy are indicated in FIG. 1 by reference indicators 18, and would, if not prevented, reduce the effect of detonation of the explosive charge 12. In the past, metal plates, such as plates 20 and 22, have been placed adjacent to the explosive charge and projectile to contain the explosive detonation products long enough to concentrate that detonation energy toward accelerating projectile 14 along path 16. Other means, such as steel bars, or the like have also been used. However, the detonation energy also accelerates these containment means outwardly along paths, such as paths 24, 26 and 28. These containment means are therefore projectile-like themselves and present a hazard to personnel or property in the vicinity of the operation.

Figure 2:
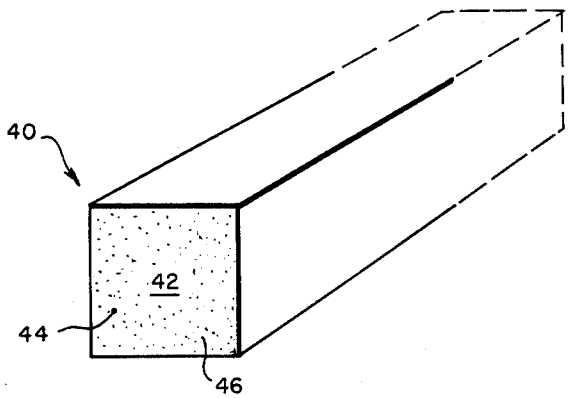
FIG. 2 is a perspective of a tamper device embodying the present invention.

Shown in FIG. 2 is a tamper mass 40 for providing temporary confinement of detonation products due to the inertia of the tamper mass itself to reduce the effects of side and end losses 18 and enable the detonation energy to be concentrated on accelerating a projectile not illustrated toward a target. The mass 40 includes particulate material 42 containing small, fine particles 44 bound together into a self-supporting shape by a binder 46. The particles 44 can be the size of S-70 Steel Shot which has a nominal size in which 80% is retained on a screen number 80 and all pass through a screen number 40 as described in MIL-S-851, Type 1, which is produced by for abrasive blasting operations. Other metallic particles can also be used, such as copper, iron fillings, or the like. A preferred binder is dental plaster; however, common plaster, adhesives and Plaster of Paris, can also be used.

The tamper mass is formed to replace the steel plates 20 and 22 of FIG. 1 and, therefore, has its size and density selected to approximate the same mass and areal density it is replacing. For example, a one inch steel plate having a specific gravity of 7.8 is replaced by 2.6 inches of tamper material having a density of three gm/cc ($1'' \times 7.8 = 2.6 \times 3$). The overall tamper density is determined by the binder and the particles used. The following is a table presenting approximate values for mixing various densities of the tamper mass assuming that the density of the binder is 1.0 gram/cc and no voids exists.

| | DENSITY (grams/cc) | | | | |
|---|---|---|---|---|---|
| | 1 | 2 | 2.5 | 3 | 7.8 |
| % Steel (by wt) | 0 | 57% | 69% | 76% | 100% |
| % Steel (by volume) | 0 | 15% | 22% | 29% | 100% |

Example:
For the above-mentioned of density of 3 grams/cc the mixture of steel to plaster/-water (by weight) is: 76/24 which is equal to the ratio of 3.2 to 1.

When substituting other fine metallic particles such as copper for the above-disclosed steel shot, the above-disclosed density characteristics will change and account of such change should be made in the specifications for the formulation of the tamper mass.

Figure 3:
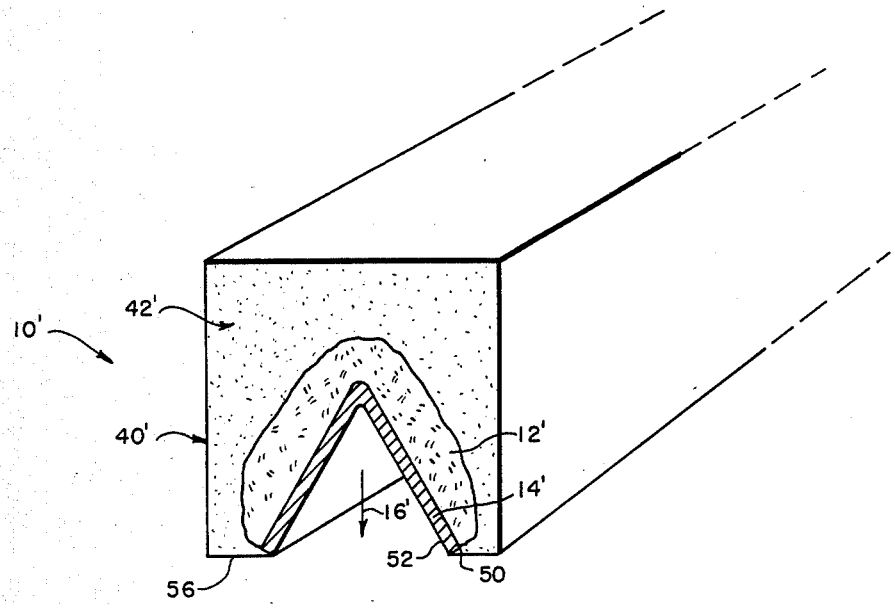
FIG. 3 is a cross-sectional perspective of a linear shaped expendable charge using a tamper device embodying the present invention.

The use of a tamper mass in place of steel plates is indicated in FIG. 3 with expendable penetrator 10' having tamper mass 40' shown as enclosing an explosive charge 12' positioned behind a projectile 14' which defines a liner of a forward facing shaped charge. The mass 10' surrounds the charge and projectile to enclose side edges 50 of the projectile and end edges (not shown). The path of projectile 14' is indicated in FIG. 3 by arrow 16'.

Upon detonation of explosive 12', tamper mass 40' remains intact long enough to direct the main thrust forward along 16' and also prevent the aforementioned end and side losses, then totally disintegrates. The small particles quickly decelerate within a small area in the vicinity of the operation. The small mass of the particles, coupled with their rapid deceleration due to high surface to mass ratio, produces a small value for the energy associated with the remnants of the disintegrated mass, whereby the possibility of damage to personnel and/or property in the vicinity of the operation is substantially reduced from that associated with the expendable projectile 10. The disintegrated mass disperses in all directions away from path 16, and, therefore, no paths corresponding to paths 24, 26 and 28 in FIG. 1.

Penetrator 10' has edge surfaces 56 and is solid enough so those edge surfaces can be used to mount the device on a target such as a wall, bomb dud, or the like. Adhesives can be used, as can mechanical straps or the like to hold it in position.

Projectile 14' is V-shaped, but can be any suitable concave shape. In fact, a concave linear shaped charge liner can be used without a projectile if suitable for the job being performed. In such a case, the behind the target damage is reduced. The amount of explosives required should be adjusted accordingly.

Figure 4:
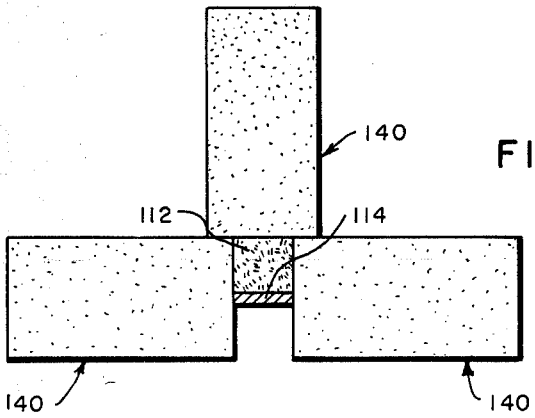
FIG. 4 is an alternate embodiment of an expendable perforator using the tamper device of the present invention.
Figure 5:
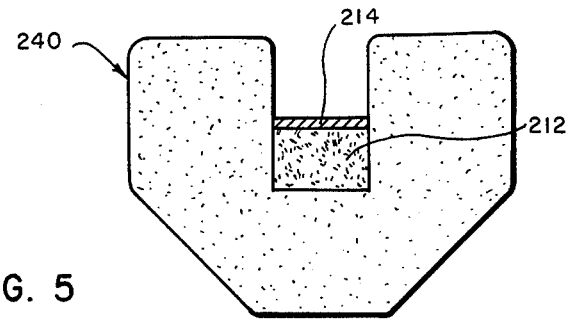
FIG. 5 is another alternate embodiment of an expendable perforator using the tamper device of the present invention.

Tamper mass 40' is monolithic; however, a plurality of monolithic masses can be used to contain an explosive. Thus, as shown in FIG. 4, a plurality of tamper masses 140 can be used in conjunction with an explosive 112 and a projectile 114. Tamper mass 240 can be suitably shaped as shown in FIG. 5. The mass 240 has the advantage of being amenable to mass production techniques. The mass can be loaded with explosive 212 and projectile 214 after production.

Figure 6:
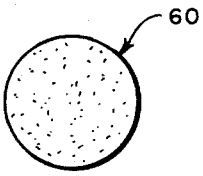
FIG. 6 is an alternate embodiment of the present invention in which the tamper mass is used as a pellet or a shot.

Shown in FIG. 6 is a tamper mass 60 in the spherical shape of a shot or a pellet. The pellet-like mass 60 can also be rectangular or cylindrical in cross section, or the like, and can be used for various ammunition, such as a 12 ga. shotgun, and will serve as a means for quickly dispersing target impact energy while still transferring substantial energy to the target for penetration. Rapid energy dispersal after impact with a target greatly reduces the possibility of damage to personnel or property located behind the target or within a certain range of the target. In this manner, a door can be penetrated using a shotgun without presenting the same danger to people behind the door as the usual shotgun ammunition. The particle mass 60 is formed using the above-described mass replacement process.

Figure 7:
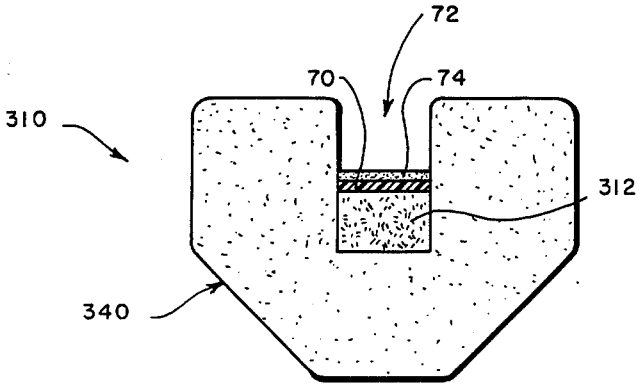
FIG. 7 is still another alternate embodiment of the present invention in which the tamper mass is also used as a projectile.

Shown in FIG. 7 is an expendable penetrator 310 in which the tamper mass 340 is shown as being similar to the FIG. 5 tamper mass; however, the tamper mass 340 can be any suitable shape. Penetrator 310 includes a charge of explosive 312 and a buffer 70 positioned in channel 72. A projectile 74 is positioned adjacent to buffer 70 and adjacent to the open path space in the channel 72 of the penetrator 310. Projectile 74 maybe formed of a tamper mass type material similar to the tamper mass 60. Projectile 74 is formed of particulate material and binder which are selected and combined to maintain its shape during detonation of the explosive. Buffer 70 is preferably formed of a plastic type material such as Teflon or Plexiglass, or the like, and functions as a wadding like material which absorbs some of the detonation energy and transfers the rest to the projectile. The projectile is also formed to remain intact until impact with a target, where it will transfer impact energy to the target, and disintegrate. The projectile, therefore, is formed using the considerations of remaining intact during detonation, then disintegrating during target impact. Projectile 74 can also include a plurality of pellet-shaped particles similar to the FIG. 6 embodiment.

In summary, there has been disclosed a novel material incorporating a frangible binder of low density along with a high-density dispersed filler material to provide the levels of tamping needed in explosive devices while essentially eliminating the hazardous fragmentation normally associated with high density tamping materials. The low-density frangible binder provides the necessary physical strength, while the high-density controlled-dispersion material (consisting of very fine particles) provides the density necessary for adequate tamping abilities. Low fragmentation is achieved by the behavior of the filler material under tensile stress, which is such that breakup into fine particles occurs. These particles, accelerated by the expanding combustion gases of the explosive, disperse and decelerate rapidly outside of the nearfield region due to their relatively high surface to mass ratio. In addition, the high density dispersed particles are not efficiently further accelerated by the expanding combustion gases, so that relatively low velocities are achieved, which, along with rapid ablation/erosion in the case of hypervelocity particles serves to limit their range of damage. For hazards to humans in particular, it is believed that the fragmentation damage radius is nearly equal to the blast damage radius, quite unlike that of a typical metallic or glass fiber encased explosive device. The principle was proven experimentally, and a device which accelerates metallic strips to high velocities, may be extended to a variety of other explosive devices requiring varying degrees of tamping along with a low-fragmentation hazard.

As experiments proved, the tamping material worked sufficiently well to allow acceleration of the strip of metal to a velocity higher than that of a comparable high strength, high density tamper. In the conventional strip charge device, the strip expands under the high stresses during launch, digging into the tamper material, and eroding along the edges.

Use of the frangible moderate density tamper material alleviated the loss of energy due to erosion while still providing the required tamping. An increase of nearly 50% in velocity was accomplished on the initial test, in comparision to an identical test using solid steel sidebars.

The concept may be extended from field fabricated materials, such as plaster of paris and iron powder, to metal-impregnated low strength plastics or metal-impregnated rubber compounds, some of which are also amenable to field fabrication at low cost. An additional extension of the type materials could be flexible binder to enable desired physical flexibility of the device such as with linear shaped charges. An additional extension of the type of materials could include highly porous metal structures formed by powder metallurgy techniques. Pressing a powder is typically done mechanically, followed by sintering to achieve strength. Elimination of the sinter stage would yield a low strength, 'green pressed' structure with strength low enough for good dispersion of the material, yet sufficient for handling purposes. Care has to be taken to ensure that the porous metal structure would not densify to the point of formation of integral fragments.

The concept may also be applied to other devices requiring some degree of tamping to minimize explosive content while requiring very low fragmentation. This could include explosive cutters, pipe cutters, cable cutters, and linear shaped charges, as well as specialized shaped charge devices, such as those used for bomb and fuzing disruption.

To those skilled in the art, many modifications and variations of the present invention are possible in light of the above teachings. It is therefore to be understood that the present invention can be practiced otherwise than as specifically described therein and still will be within the spirit and scope of the appended claims.

What is claimed is:

1. A blast confinement means for temporarily confining detonation products associated with a blast comprising:

a tamper mass associated with an explosive to enclose a portion of that explosive, said tamper mass including a particulate material and a binder means for binding particles in said particulate material together into a self-supporting structure which temporarily contains the products associated with detonation of the explosive for reducing the loss of such products and enables the detonation energy to be concentrated toward a target and then disintegrates into a multiplicity of low energy particles.

2. The blast confinement means as defined in claim 1 wherein said binder material includes a rigid binder.

3. The blast confinement means defined in claim 1 further including a projectile formed of the material of the tamper mass and a buffer means interposed between said projectile and an explosive charge for attenuating detonation energy associated with that explosive charge so that said projectile is not disintegrated by the detonation energy.

4. The blast confinement means defined in claim 1 wherein said binder material includes a flexible plaster.

5. The blast confinement means defined in claim 1 wherein said particulate material comprises fine particles selected from the group consisting of steel, copper and lead.

6. The blast confinement means defined in claim 1 wherein said self-supporting structure is rectangular in cross-section.

7. The blast confinement means defined in claim 1 wherein said self-supporting structure is V-shaped in cross-section.

8. The blast confinement means defined in claim 1 wherein a projectile is located on one surface of an explosive and said tamper mass is in the shape of a monolithic structure completely covering all other surfaces of the explosive and having an open space adjacent to the projectile to define an open path to be traversed by the projectile as it moves toward an object to be penetrated.

9. The blast confinement means defined in claim 3 wherein said projectile includes a plurality of pellet-shaped particles.

10. A pellet-like mass comprising:

a particulate material and a binder means for binding particles in said particulate material together in a self-supporting shape which temporarily retains its shape upon impact with a target to concentrate impact energy toward penetrating that target then disintegrates into a multiplicity of low energy particles.

11. The pellet-like mass as defined in claim 10 wherein said self-supporting shape is spherical.

12. The pellet-like mass as defined in claim 10 wherein said self-supporting shape is cylindrical.

* * * * *